US011504640B1

(12) United States Patent
Boyson

(10) Patent No.: US 11,504,640 B1
(45) Date of Patent: Nov. 22, 2022

(54) LAUNCH ACCELEROMETER FOR MODEL ROCKET

(71) Applicant: Honeywell Federal Manufacturing & Technologies, LLC, Kansas City, MO (US)

(72) Inventor: Jonathan M. Boyson, Grain Valley, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 0 days.

(21) Appl. No.: 17/380,389

(22) Filed: Jul. 20, 2021

(51) Int. Cl.
*A63H 27/00* (2006.01)
*A63H 27/14* (2006.01)

(52) U.S. Cl.
CPC ..... *A63H 27/005* (2013.01); *A63H 27/14* (2013.01)

(58) Field of Classification Search
CPC ..... A63H 27/003; H01H 35/14
See application file for complete search history.

(56) References Cited

U.S. PATENT DOCUMENTS 3,001,043 A 9/1961 Evans
3,038,973 A * 6/1962 Alpert ..... F42C 19/06 116/DIG. 9
3,226,504 A 12/1965 Gallistel et al.
3,337,701 A 8/1967 Prebilic
3,715,535 A * 2/1973 Urenda ..... H01H 35/14 73/1.38
3,859,483 A * 1/1975 Laserson ..... H01H 35/145 200/61.45 R
4,266,107 A * 5/1981 Abbin, Jr. ..... H01H 35/142 200/61.53
4,331,848 A * 5/1982 Schneider, Jr. ..... H01H 35/146 200/61.5
5,692,580 A * 12/1997 Maiwald ..... B60R 21/33 180/282
8,869,700 B2 10/2014 Rastegar
9,378,909 B2 6/2016 Gass et al.
2016/0025473 A1 1/2016 Rastegar

* cited by examiner

*Primary Examiner* — John A Ricci
(74) *Attorney, Agent, or Firm* — Erise IP, P.A.

(57) ABSTRACT

Systems and methods of detecting launch of a model rocket are described herein. A mechanically implemented launch accelerometer may be disposed on a model rocket. The launch accelerometer may detect acceleration of the rocket by a mass of the launch accelerometer moving relative to the rocket and against a spring force based on the rocket acceleration. The mass may comprise a first electrical contact that may contact a second electrical contact when the mass is accelerated beyond a threshold, which is indicative of launch of the rocket. The contact between the first electrical contact and the second electrical contact may complete an electrical circuit. Furthermore, at least one pin may lock the mass in a position allowing the electrical circuit to remain complete.

20 Claims, 5 Drawing Sheets

LAUNCH ACCELEROMETER FOR MODEL ROCKET

STATEMENT OF GOVERNMENTAL SUPPORT

This invention was made with government support under DE-NA0002839 awarded by the United States Department of Energy/National Nuclear Security Administration. The government has certain rights in the invention.

BACKGROUND

1. Field

Embodiments of the invention relate to detecting a take-off acceleration of a model rocket. More specifically, embodiments of the invention relate to a mechanical launch accelerometer for detecting take-off of a model rocket.

2. Related Art

Typical model rockets utilize engines with a final explosive stage that when detonated separates a body of the model rocket deploying a model rocket recovery system. A typical model rocket recovery system comprises an elastic band and a parachute to gently return the model rocket to earth. In some cases, the model rocket may comprise sensors for detecting launch or altitude and activating flight mode in a flight controller, which controls actions after launch, including deploying the model rocket recovery system. The sensors may not be entirely reliable and sometimes activate before the desired rocket stage, after the desired rocket stage, or, in some cases, while still on the ground. When the rocket recovery system is activated on the ground, an explosive device or an actuator may provide necessary energy to separate the model rocket while a user is in proximity. For example, a sensor used to deploy the rocket recovery system may be a barometer measuring atmospheric pressure. A change in weather conditions may drastically and suddenly change the atmospheric pressure and mistakenly deploy the recovery system prematurely while near the user. Similarly, if power is connected to the sensors and the user moves the rocket or bumps the rocket, a noise spike in the signal from the sensor may cause premature deployment of the recovery system. The above-described problems with typical current systems may be solved by the mechanically implemented launch acceleration detection systems and methods described herein.

SUMMARY

Embodiments of the invention solve the above-described problems by providing systems and methods for mechanically detecting launch of a high-powered model rocket and initiating flight control sequences based on the launch detection. Furthermore, the launch acceleration detection systems and methods may be used as primary and secondary systems to provide redundancy in launch detection and recovery systems deployment.

A first embodiment is directed to a launch detection system for detecting an acceleration of a model rocket. The system comprises a housing comprising an upper housing portion and a lower housing portion, a shaft connecting the upper housing portion and the lower housing portion, a movable mass disposed on the shaft and configured to move along the shaft, a spring disposed between the mass and the lower housing portion, a first electric terminal disposed on the mass, and a second electric terminal disposed on the lower housing portion, wherein, when the model rocket accelerates, the mass moves to a lower position where the first electric terminal connects to the second electric terminal, thereby completing a circuit and allowing electric current to flow.

A second embodiment is directed to a method of detecting launch acceleration of a model rocket. The method comprises the steps of launching the model rocket, said rocket comprising a housing having an internal mass and compressible spring located therein, said internal mass having first electrical contacts thereon and said housing having second electrical contacts thereon, accelerating the internal mass to move relative to the housing based on the launch, compressing the spring as the internal mass moves, and completing an electrical circuit by contacting the first electrical contacts with the second electrical contacts.

A third embodiment is directed to an acceleration detection system for detecting launch of a model rocket. The system comprises a housing comprising a post extending between a top and a bottom portion, a mass movably mounted on the post, a spring surrounding the post and disposed between the mass and the bottom portion, wherein the mass is configured to move from a first top position to a second bottom position due to acceleration of the rocket against a resistance of the spring, a first electric terminal disposed on the mass, and a second electric terminal disposed on the bottom portion, and a locking mechanism for locking the mass in the bottom position.

Another embodiment is directed to an acceleration detection system for detecting an acceleration of a model rocket. The acceleration detection system comprises a housing comprising an upper housing portion and a lower housing portion, a cylinder extending between the upper housing portion and the lower housing portion, a mass disposed on the cylinder and configured to slide along the cylinder, a spring disposed between the mass and the lower housing portion, a first electric terminal disposed on the mass, a second electric terminal disposed on the lower housing portion, a pin disposed in a hole in the mass, a pin spring disposed in the mass and connected to the pin, and a housing hole disposed in the housing, wherein the mass, under the acceleration by the model rocket, is configured to slide down the cylinder into a lower position against a resistance of the spring, and wherein the pin is configured to extend under a force of the pin spring into the housing hole locking the mass in the lower position contacting the first electric terminal to the second electric terminal. The embodiment is further configured with a flight computer for receiving a signal from the contact between the first electric terminal and the second electric terminal and controlling sensors and actuators controlling deployment of a flight recovery system and controls on the model rocket, wherein the model rocket is a redundant system and the flight recovery system is only deployed when launch has been detected.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
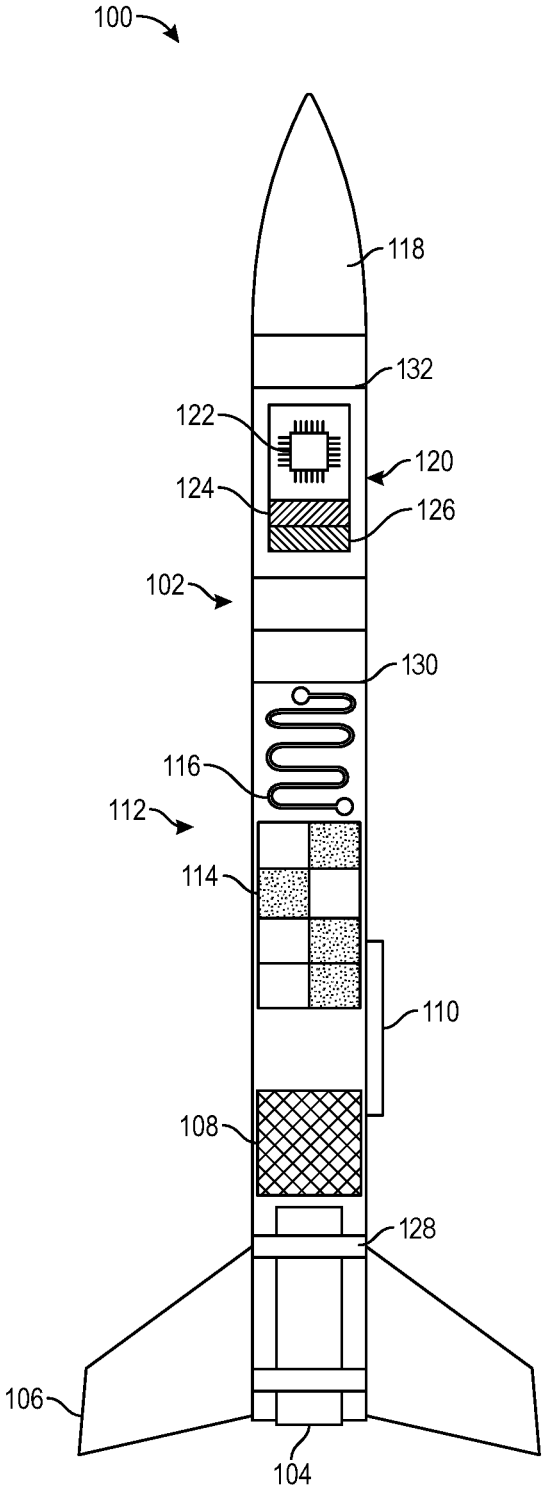
FIG. 1 depicts an exemplary high-powered model rocket.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized, and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

In some embodiments, a launch accelerometer is added to or produced with a high-powered model rocket as a primary or secondary indicator of launch to a flight computer. In some embodiments, the launch accelerometer may be a mechanical acceleration detection system that detects acceleration by movement of a mass. The launch accelerometer may comprise a weight, a shaft, a spring, and a locking mechanism. Upon acceleration of the rocket, the inertia of the mass may cause compression of the spring and resultant contact between electrical leads may complete a circuit, thereby sending a signal to a flight computer indicative of launch of the rocket. Furthermore, the locking mechanism may lock the mass in place resulting in a continuously complete circuit.

In some embodiments, the launch accelerometer may be used as a primary or secondary launch detection system for providing redundant launch detection. The launch accelerometer may provide a backup to the recovery system deployment such that if a primary sensor system fails or if a charge in the engine fails to provide enough pressure to separate the rocket body and deploy the recovery system, the launch accelerator system may still activate a flight mode and deploy the recovery system.

FIG. 1 depicts an exemplary rocket 100 which, in some embodiments, may be a high-powered model rocket. In some embodiments, rocket 100 comprises body 102, engine 104, fins 106, recovery wadding 108, launch lug 110, recovery system 112 including parachute 114 and recovery line 116, nose cone 118, and flight system 120 including flight computer 122, sensors 124, and power source 126. In some embodiments, body 102 may be a hollow tube with ribs and firewalls to provide structure and to separate compartments. The separate compartments may house various items required for launch and recovery of rocket 100. For example, engine 104 may be secured into rocket 100 by surrounding structure 128. Recovery system 112 may be separated from flight system 120 by firewall 130, and flight system 120 may be separated from nose cone 118 by nose firewall 132. In some embodiments, the firewalls may have holes (not shown) drilled through for running electrical cables connecting the components. For example, firewall 130 may comprise at least one hole allowing electrical cables to connect flight system 120 to an ejection device for separating body 102 at firewall 130 to allow parachute 114 to be ejected into the air and allow rocket 100 to return to earth safely after launch. Furthermore, electrical wires may run through firewall 130 to connect flight system 120 to launch accelerometer 200 depicted in FIGS. 2A and 2B.

In some embodiments, engine 104 may be selected based on the size and weight of rocket 100. Rocket 100 may be described as a high-powered rocket herein; however, any classification of rocket 100 and engine 104 may be used with launch accelerometer 200. In some embodiments, engine 104 may comprise various levels of material to provide various thrust phases and may include an explosive charge to separate body 102 of rocket 100 and deploy recovery system 112. In some embodiments, engine 104 may be any off-the-shelf engine or may be homemade. Engine 104 may be classified based on the thrust or impulse provided by engine 104. In some embodiments, properties of launch accelerometer 200 may be based on the classification of engine 104.

In some embodiments, recovery system 112 may comprise parachute 114 and recovery line 116. In some embodiments, flight system 120 may send a signal to an ejection device (not shown) that separates body 102 allowing parachute 114 to exit body 102, catch air, and slowly allow rocket 100 to float to the ground. In some embodiments, the ejection device may be an explosive device or an electromechanical actuator of recovery system 112. Parachute 114 may be attached to body 102 by recovery line 116. In some embodiments, recovery line 116 may be composed of an elastic material such that recovery line 116 is not ripped away from body 102 or parachute 114 during descent.

In some embodiments, flight system 120 comprises flight computer 122, sensors 124, and power source 126. Flight system 120 may be disposed near or in nose cone 118 or may be disposed in any other section of body 102. Flight system 120 may comprise flight computer 122, which may execute a flight mode of rocket 100. In some embodiments, the flight mode may be executed to control the timing of the ejection device such that body 102 separates and parachute 114 is deployed when rocket 100 has reached a peak altitude or soon thereafter. In some embodiments, flight computer 122 may comprise a processor, or microcontroller, receiving a signal from launch accelerometer 200 indicative of launch and, after a predetermined time period, send a signal to activate recovery system 112, separating body 102 and deploying parachute 114. In some embodiments, flight computer 122 comprises one or more non-transitory computer-readable media storing computer-executable instructions that, when executed by the processor, perform the methods of operating the flight modes described herein.

In some embodiments, flight computer 122 may comprise computer-readable media, such as non-transitory computer-readable media. Computer-readable media include both volatile and nonvolatile media, removable and nonremovable media, and contemplate media readable by a database. For example, computer-readable media include (but are not limited to) RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data temporarily or permanently. However, unless explicitly specified otherwise, the term "computer-readable media" should not be construed to include physical, but transitory, forms of signal transmission such as radio broadcasts, electrical signals through a wire, or light pulses through a fiber-optic cable. Examples of stored information include computer-useable instructions, data structures, program modules, and other data representations. In some embodiments, flight computer 122 may receive signals indicative of launch or a state of rocket 100 and send a signal to the various sensors and actuators controlling operation of rocket 100.

In some embodiments, sensors 124 may comprise accelerometers, gyroscopes, barometers, and/or any other sensors that may generate data that may be used to control rocket 100 described herein. In an exemplary embodiment, sensors 124 may be a barometer and measure atmospheric pressure. The barometer may be calibrated at ground level such that atmospheric ground pressure is established as a base altitude. At a given pressure altitude measurement, flight computer 122 may send a signal to recovery system 112 to activate and deploy parachute 114. In one embodiment, sensors 124 may comprise a micro electromechanical accelerometer that may send a signal to flight computer 122 indicative of the accelerations experienced by rocket 100. Flight computer 122 may receive the signals and detect an initial acceleration from launch and a slow deceleration until peak altitude is achieved. Upon acceleration in a downward direction, flight computer 122 may send a signal activating ejection device thereby deploying parachute 114. In some embodiments, sensors 124 may be primary sensors and launch accelerometer 200 may be a secondary (e.g., back up) sensor. In some embodiments, launch accelerometer 200 may be a primary sensor and replace sensors 124.

Figure 2A:
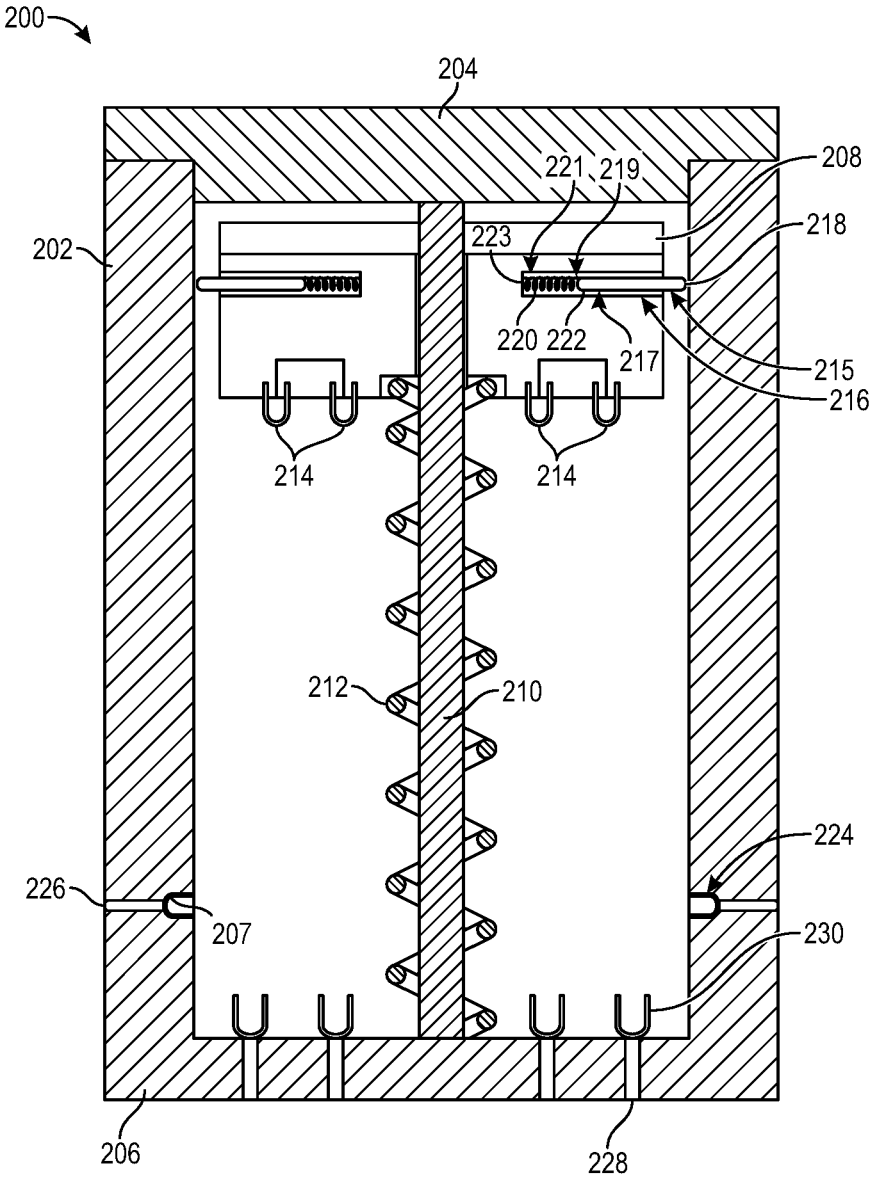
FIGS. 2A-2B depict an embodiment of a launch accelerometer in two stages.
Figure 2B:
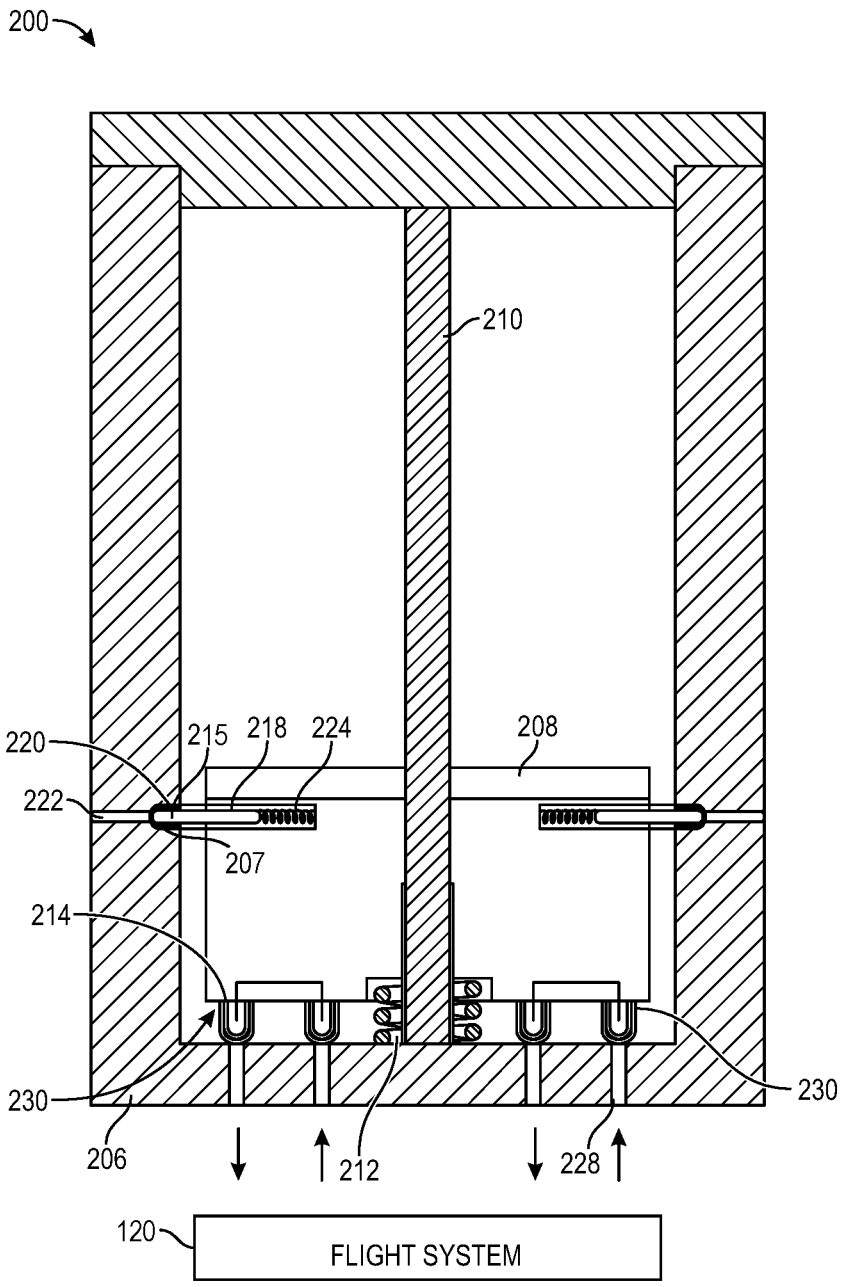

FIGS. 2A-2B depict an embodiment of launch accelerometer 200. In some embodiments, launch accelerometer 200 comprises housing 202 including upper housing portion 204 and lower housing portion 206, mass 208, shaft 210, spring 212, upper electrical terminals 214, and one or more locking mechanisms 216. In some embodiments, shaft 210 may be a cylinder, a rod, a post, a pole, a rail, a bar, or any other longitudinal extension. In some embodiments, shaft 210 may have a curved outer longitudinal surface for receiving spring 212 therearound. In some embodiments, spring 212 may be a compression spring having a helical, spiral or cylindrical configuration. In some embodiments, spring 212 may have a square, rectangular, or other non-circular shape. Additionally, other configurations for spring 212 may be contemplated. In some embodiments, launch accelerometer 200 includes two locking mechanisms 216 on opposing sides. In some embodiments, more than two locking mechanisms 216 may be included. In some embodiments, multiple locking mechanisms 216 may be evenly spaced around the circumference of the housing 202. In some embodiments, multiple locking mechanisms 216 may be spaced in any arrangement around the housing 202 at the same longitudinal position.

In some embodiments, locking mechanism 216 comprises pin 218, bore 222, pin spring 220, housing detent 224, and access hole 226. In some embodiments, bore 222 may extend into mass 208 at an angle relative to shaft 210. In some embodiments, bore 222 may extend into mass 208 at an angle substantially perpendicular to shaft 210. Bore 222 may extend only partially into the mass 208 such that it does not contact shaft 210. Bore 222 may have a closed internal end 223 that receives pin spring 220 therein. Pin 218 may also be received within bore 222. Pin 218 may have a first end 217 and a second end 215. First end 221 of pin spring 220 may contact closed internal end 223 of bore 222. Second end 219 of pin spring 220 may contact first end 217 of pin 218. Second end 215 of pin 218 extends out of the distal end of bore 222 and the mass 208 a distance D when pin spring 220 is in its compressed position, such that second end 215 of pin 218 contacts an inner surface 207 of lower housing portion 206, as seen in FIG. 2A when not in a lower locked position, which is seen in FIG. 2B.

Furthermore, launch accelerometer 200 may comprise lower electrical terminals 230 connected to electric leads 228 that are connected to flight system 120. In some embodiments, mass 208 may be disposed on and may be configured to move or slide longitudinally along shaft 210. In some embodiments, shaft 210 may comprise plastic, metal, or any other material that may be strong enough to withstand the forces of rocket launch and recovery, yet light enough such that rocket launch and flight stability is not significantly impacted. Shaft 210 may be fixedly attached at its ends to housing 202 at upper housing portion 204 and lower housing portion 206 such that shaft 210 may remain stationary relative to rocket 100 during flight. Mass 208 may be held in an upper position by spring 212 as shown in FIG. 2A when spring 212 is in its relaxed state. Launch accelerometer 200 may be disposed at any location in rocket 100 as described in detail below.

In some embodiments, when rocket 100 accelerates upward, mass 208, due to inertia, moves upward at a slower rate relative to body 102. The difference in acceleration may compress spring 212 that is attached to both mass 208 and housing 202. When rocket 100 accelerates at a high enough rate, spring 212 may be compressed such that upper electrical terminals 214 disposed on mass 208 contact lower electrical terminals 230 disposed on lower housing portion 206. The contact between upper electrical terminals 214 and lower electrical terminals 230 may complete a circuit comprising flight system 120. Furthermore, pin 218 may be extended into housing detent 224 to lock mass 208 at a lower position as depicted in FIG. 2B.

FIG. 2B depicts mass 208 locked into the lower position, where upper electrical terminals 214 and lower electrical terminals 230 complete the circuit connected to flight system 120. As mass 208 moves longitudinally downward relative to body 102, spring 212 may compress until at least one pin 218 lines up and is received into housing detent 224. As discussed above, first end 217 of pin 218 may be connected to and/or in contact with second end 219 of pin spring 220, which may be compressed when pin 218 is in a partially retracted position and when mass 208 is in the upper position, allowing mass 208 to slide along shaft 210. When mass 208 is in the lower position, second end 215 of pin 218 may extend into housing detent 224, thereby locking mass 208 into the lower position.

In some embodiments, housing 202 may comprise at least one additional access hole 226. Access hole 226 extends through sidewall of body 102 and into wall of housing 202 to cooperate with housing detent 224. After mass 208 has locked into the lower position and pin 218 is extended into housing detent 224 by pin spring 220, pin 218 may be pressed back into the partially retracted position by inserting a small object such as, for example, a small screwdriver, through access hole 226 from the exterior surface. Pressing an object against pin 218 compresses pin spring 220 such that pin 218 is partially retracted and mass 208 may slide longitudinally back up the shaft under the force of spring 212.

In some embodiments, a size and weight of mass 208 may be based on the size and/or a classification of rocket 100 or a classification of engine 104 as described above. The thrust of engine 104 may result in acceleration of rocket 100 and therefore, may be indicative of the force that mass 208 applies to spring 212. Therefore, a compression rate and distance of spring 212 may be selected based on the expected acceleration of mass 208 relative to rocket 100. A size and weight of mass 208 and a spring constant of spring 212 may be selected based on the classification of engine 104. As such, launch accelerometer 200 may be selected based on a classification of engine 104 and/or a classification of rocket 100.

In some embodiments, various launch accelerometers may be provided based on various classifications of engine 104. Typical engine classifications are designated as A-F with each designation being twice as much as the last. For example, 4A=2B=C, with A=1.26 to 2.5 Newton-seconds, and so forth. A classification of engine 104 that results in a higher acceleration of mass 208 based on the weight of rocket 100 may require a spring 212 with a higher spring constant or a mass 208 with a lower mass to maintain a constant acceleration of mass 208. Launch accelerometer 200 may be selected such that acceleration of mass 208 may be within a range allowing mass 208 to avoid impacting lower housing portion 206 with a force to damage mass 208 and/or housing 202. A table comprising launch accelerometer 200 variations may be associated with various classifications for engines 104 such that a user may easily select the correct launch accelerometer 200 for rocket 100 depending on the classification of engine 104.

In some embodiments, when mass 208 is locked into the lower position, as seen in FIG. 2B, upper electrical terminals 214 may contact lower electrical terminals 230 connecting the circuit including flight system 120. Electric leads 228 may be connected to flight system 120 such that when mass 208 is in the upper position the circuit is incomplete. When upper electrical terminals 214 contact lower electrical terminals 230, a circuit is completed. Then, a signal sent from flight system 120 can flow through launch accelerometer 200 and return to flight system 120 via electric leads 228. As such, receiving the return signal at flight system 120 may be indicative of launch of rocket 100.

In some embodiments, flight computer 122 may receive the return signal via launch accelerometer 200. The received signal may be indicative of the launch of rocket 100. Consequently, flight computer 122 may initiate flight mode. Flight mode may be any activation of sensors 124, actuators, or any other electrical or electromechanical device that may control operation of rocket 100. For example, flight computer 122 may include on-board programing that includes a timer. The timer may start when flight mode is initiated by receipt of the return signal from launch accelerometer 200. In some embodiments, the timer may count down from a starting number to a predetermined stop number, and when the predetermined stop number is reached, the ejection device may be activated.

In some embodiments, initiation of flight mode also initiates activation of sensors 124. For example, flight computer 122 may receive the return signal from launch accelerometer 200 and initiate flight mode. When flight mode is initiated, flight computer 122 may send signals activating sensors 124 and/or actuators. In some embodiments, sensors 124 are activated to record data such as, for example, location data, atmospheric data, pressure data, temperature data, speed data, direction data, orientation data, dynamic data, kinematic data, and any other data that may be useful in embodiments described herein. The data may be used to deploy recovery system 112 at an appropriate portion of the flight envelope. In some embodiments, flight computer 122 includes an autopilot which controls control surfaces (e.g., fins 106) based on the data of rocket 100.

In some embodiments, detection of launch by flight computer 122 from launch accelerometer 200 may disable flight controls. When flight computer 122 receives the signal to initiate flight mode, flight controls may be activated as described above. In some embodiments, when the timer to deploy recovery system 112 has ended, or after another predetermined set of time, the flight controls may also be deactivated. As such, the flight controls may not be operational during descent of rocket 100. In some embodiments, the flight controls may be deactivated based on sensors 124 such as, for example, an accelerometer indicating that rocket 100 is falling.

In some embodiments, launch accelerometer 200 may be a secondary launch indicator and may be used in conjunction with sensors 124. For example, a barometer may measure atmospheric pressure and activate recovery system 112 at a particular pressure altitude. In some embodiments, the timer may also be initiated when flight mode is activated. Therefore, in some embodiments, a redundant system exists, and whichever control operation comes first, deploys recovery system 112. If the first system fails, the second redundant system will then deploy recovery system 112.

In some embodiments, launch accelerometer 200 prevents initiation of the flight mode if a sensor fails and launch accelerometer 200 has not yet detected launch. In some embodiments, recovery system 112 may not be activated based on the state of rocket 100 determined by flight computer 122 either receiving or not receiving the return signal from launch accelerometer 200. For example, if launch accelerometer 200 has not completed the circuit, and initiated flight mode, flight computer 122 may remain in a pre-launch (or unlaunched) state. Flight computer 122 may also store programming that a signal to activate recovery system 112 may only be sent during flight mode. Therefore, if rocket 100 is on the ground and the atmospheric pressure suddenly drops below the activation pressure of the barometer due to a weather front, recovery system 112 may not be activated because launch accelerometer 200 has not yet indicated launch and, therefore, flight computer 122 is not in flight mode. As such, rocket 100 remains in a pre-launch state and does not deploy recovery system 112 prematurely.

Figure 3:
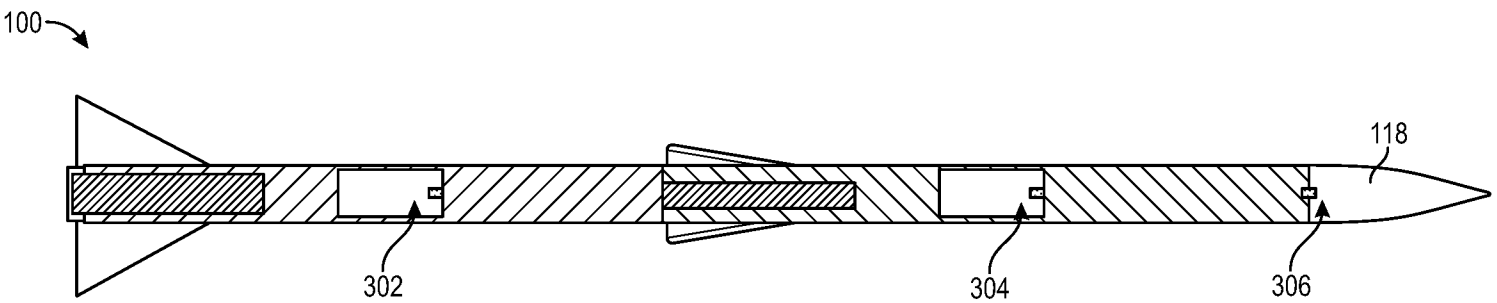
FIG. 3 depicts an exemplary high-powered model rocket illustrating exemplary placement locations of the launch accelerometer.

FIG. 3 depicts exemplary locations for mounting launch accelerometer 200 in rocket 100 which, in this embodiment, is a two-stage high-powered model rocket. As described above, rocket 100 may comprise various compartments separated by ribs and firewalls. Launch accelerometer 200 may be sized such that launch accelerometer 200 may fit any classification of rocket 100. For example, if rocket 100 is classified with a D classified engine, launch accelerometer 200 may be sized to fit rockets with a D classified engine. Various sizes of launch accelerometer 200 may be available for each classification as described above. Furthermore, here, rocket 100 may comprise at least three payload locations where launch accelerometer 200 may be disposed. Launch accelerometer 200 may be disposed in aft location 302, central location 304, or forward location 306 near nose cone 118. In some embodiments, it may be desirable for launch accelerometer 200 to be disposed as far aft as possible such that launch accelerometer 200 may act to further stabilize rocket 100; however, launch accelerometer 200 may be of a size and a weight that has negligible effect on the stability of rocket 100. As such, launch accelerometer 200 may be disposed at any location in rocket 100. In some embodiments, launch accelerometer 200 may be disposed aft of a center of gravity of rocket 100 to maintain stability.

Figure 4:
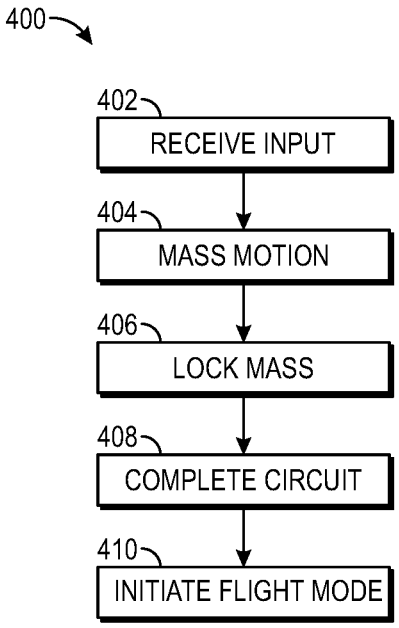
FIG. 4 depicts an exemplary method of detecting launch of a high-powered model rocket using the launch accelerometer.

FIG. 4 depicts an exemplary method of detecting the launch of rocket 100 and initiating flight mode using launch accelerometer 200 generally referenced by numeral 400. At step 402, launch input may be received by launch accelerometer 200. Launch may be initiated by a user of rocket 100 by transmitting an electric signal to engine 104 and igniting engine 104. Engine 104 may provide thrust to rocket 100 indicative of the classification of engine 104 described above. As such, rocket 100 may launch from the ground accelerating upward. The acceleration of rocket 100 may result in a lagged acceleration of launch accelerometer 200 due to the inertia of mass 208.

At step 404, mass 208 of launch accelerometer 200 may accelerate relative to rocket 100. Rocket 100 may accelerate upward based on the thrust provided by engine 104. As rocket 100 accelerates upward, mass 208 also accelerates upward; however, due to the inertia of mass 208 and compression of spring 212, the acceleration of mass 208 may be less than the acceleration of rocket 100. Therefore, mass 208 may move to an aft portion of rocket 100 based on the acceleration of rocket 100. Mass 208 may move aft relative to rocket 100 along shaft 210 compressing spring 212. The spring constant associated with spring 212 may be selected based on the thrust provided by engine 104. As such, mass 208 may move in a controlled manner.

At step 406, launch accelerometer 200 may be locked into place by locking mechanism 216 as described above. In some embodiments, locking mechanism 216 may comprise pin 218 and pin spring 220 disposed in bore 222. When mass 208 is in the upper location, pin 218 may be in a partially retracted position. Housing detent 224 may be positioned in housing 202 proximate lower housing portion 206 such that when mass 208 is in a lower position, pin 218, under force from pin spring 220, may be extended into housing detent 224. When pin 218 are extended into housing detent 224, mass 208 may be locked in the lower position.

At step 408, upper electrical terminals 214 may complete the circuit initiating flight mode as described above. When mass 208 is locked into the lower position, upper electrical terminals 214 disposed on mass 208 may contact lower electrical terminals 230 completing the circuit, which includes flight system 120. Flight computer 122 may receive a signal sent from flight system 120 through electric leads 228 through mass 208 via lower electrical terminals 230 and upper electrical terminals 214. The circuit is not complete and therefore, the signal may not pass to flight computer 122 when mass 208 is not in the lower position. Thus, receiving the signal at flight computer 122 is indicative of the mass being in the lower position and, therefore, is indicative of the launch of rocket 100. Because, receiving the signal at flight computer 122 is indicative of launch of rocket 100, flight computer 122 may initiate flight mode based on receipt of the signal.

At step 410, flight mode may be initiated and carried out based on the received signal, which is indicative of launch. In some embodiments, flight computer 122 may initiate flight mode when the signal is received via launch accelerometer 200. In some embodiments, flight mode may also activate sensors and electromechanical actuators to control flight operations of rocket 100. In some embodiments, flight mode may initiate deployment of recovery system 112, may allow deployment of recovery system 112, may allow operation of control surfaces, and/or may allow transmission of any signals and operation of any sensors and/or actuators of rocket 100.

Although the invention has been described with reference to the embodiments illustrated in the attached drawing figures, it is noted that equivalents may be employed, and substitutions made herein without departing from the scope of the invention as recited in the claims.

Having thus described various embodiments of the invention, what is claimed as new and desired to be protected by Letters Patent includes the following:

1. An launch detection system for detecting an acceleration of a model rocket, the system comprising:
- a housing comprising an upper housing portion and a lower housing portion;
- a shaft connecting the upper housing portion and the lower housing portion;
- a movable mass disposed on the shaft and configured to move along the shaft;
- a spring disposed between the mass and the lower housing portion;
- a first electric terminal disposed on the mass; and
- a second electric terminal disposed on the lower housing portion;
- wherein, when the model rocket accelerates, the mass moves to a lower position where the first electric terminal connects to the second electric terminal, thereby completing a circuit and allowing electric current to flow.

2. The acceleration detection system of claim 1, further comprising at least one locking mechanism comprising:
- a pin having a first end and a second end disposed in a bore in the mass;
- a pin spring disposed in the bore in contact with the second end of the pin; and
- a detent in the inner wall of the housing;
- wherein when the mass is in the lower position, the pin extend under a force of the pin spring into the detent to lock the mass in the lower position.

3. The acceleration detection system of claim 2, further comprising at least one access hole in the housing and a sidewall of the model rocket to allow access to the pin.

4. The acceleration detection system of claim 1, further comprising a flight computer configured to initiate a flight mode when the circuit is complete.

5. The acceleration detection system of claim 4, further comprising a rocket recovery system,
- wherein the flight computer is configured to initiate deployment of a rocket recovery system when the circuit is complete.

6. The acceleration detection system of claim 5, further comprising a sensor in communication with the rocket recovery system, wherein the acceleration detection system is configured to be a redundant system.

7. The acceleration detection system of claim 5, wherein the spring is fixedly attached to the mass and the housing and surrounds the shaft.

8. The acceleration detection system of claim 1, wherein the spring has a spring constant based at least in part on a classification of an engine of the model rocket.

9. A method of detecting launch acceleration of a model rocket, the method comprising the steps of:

launching the model rocket, said rocket comprising a housing having an internal mass and compressible spring located therein, said internal mass having first electrical contacts thereon and said housing having second electrical contacts thereon;

accelerating the internal mass to move relative to the housing based on the launch;

compressing the spring as the internal mass moves; and completing an electrical circuit by contacting the first electrical contacts with the second electrical contacts.

10. The method of claim 9 further comprising the steps of:

receiving a signal at a flight computer and activating a flight mode of the model rocket based on the received signal; and activating a model rocket recovery system based on the flight mode.

11. The method of claim 9, further comprising the step of:

locking the mass into a lower position when the electrical circuit is complete.

12. The method of claim 11, wherein the internal mass comprises at least bore having a spring and a pin received therein, and the housing includes at least one detent in an inner surface, wherein locking the mass in the lower position comprises extending a pin out of the at least one bore into the at least one detent.

13. The method of claim 11, wherein the internal mass comprises two bores, each having a spring and a pin received therein, and the housing includes two detents in an inner surface, wherein locking the mass in the lower position comprises extending a pin out of the bores into the detents.

14. The method of claim 9, further comprising the step of:

activating deployment of a rocket recovery system by a flight computer when the model rocket is in a flight mode.

15. An acceleration detection system for detecting launch of a model rocket, the system comprising:

a housing comprising a post extending between a top and a bottom portion;

a mass movably mounted on the post;

a spring surrounding the post and disposed between the mass and the bottom portion, wherein the mass is configured to move from a first top position to a second bottom position due to acceleration of the rocket against a resistance of the spring;

a first electric terminal disposed on the mass; and a second electric terminal disposed on the bottom portion; and a locking mechanism for locking the mass in the bottom position.

16. The acceleration detection system of claim 15, further comprising a circuit that is completed when the first electric terminal contacts the second electric terminal when the mass is in the bottom position.

17. The acceleration detection system of claim 15, further comprising a flight computer controlling deployment of a rocket recovery system based on the contact of the first electric terminal to the second electric terminal.

18. The acceleration detection system of claim 17, wherein the flight computer is operable to receive a signal from at least one sensor causing deployment of the rocket recovery system.

19. The acceleration detection system of claim 18, wherein the rocket recovery system is only deployed if the electrical circuit is complete.

20. The acceleration detection system of claim 15, wherein the acceleration detection system is disposed in the model rocket aft of a center of gravity of the model rocket to stabilize the model rocket in flight.

* * * * *